United States Patent [19]

Maier et al.

[11] 4,263,492

[45] Apr. 21, 1981

[54] CIRCUIT BREAKER WITH ANTI-BOUNCE MECHANISM

[75] Inventors: Alfred E. Maier, Beaver Falls; James R. Farley, Plum, both of Pa.

[73] Assignee: Westinghouse Electric Corp., Pittsburgh, Pa.

[21] Appl. No.: 77,530

[22] Filed: Sep. 21, 1979

[51] Int. Cl.[3] ..... H01H 3/60

[52] U.S. Cl. ..... 200/288; 200/323; 200/327

[58] Field of Search ..... 200/288, 318, 323, 324, 200/327, 153 G, 153 SC

[56] References Cited

U.S. PATENT DOCUMENTS

| | | | |
|---|---|---|---|
| 3,832,504 | 8/1974 | Cellerini et al. | 200/153 SC |
| 4,064,383 | 12/1977 | Barkan | 200/288 |
| 4,099,039 | 7/1978 | Barkan | 200/288 |
| 4,114,005 | 9/1978 | Mailer | 200/153 G |
| 4,121,077 | 10/1978 | Mrenna et al. | 200/308 |

*Primary Examiner*—Willis Little

*Attorney, Agent, or Firm*—L. P. Johns

[57] ABSTRACT

A circuit breaker with an anti-bounce mechanism characterized by separable contact means operable between open and closed positions and including a cross bar, an operating mechanism releasable to effect movement of the contacts and comprising a link connected to the cross bar, means for preventing bouncing of the cross bar when the contacts are open and comprising a stop member engageable with the length.

5 Claims, 3 Drawing Figures

II
II
7
9
13
15
17
19
25
27
29
31
33
35
37
39
39
41
43
45
45
47
49
51
53
59
63
67
69
71
73

CIRCUIT BREAKER WITH ANTI-BOUNCE MECHANISM

CROSS REFERENCE TO RELATED APPLICATIONS

This application is related to the copending application of Alfred E. Maier and Walter V. Bratkowski, Ser. No. 62,273, filed July 30, 1979.

BACKGROUND OF THE INVENTION

1. Field of the Invention

This invention relates to a circuit breaker having an anti-bounce mechanism for preventing reclosing of the contacts after the contacts are opened.

2. Description of the Prior Art

A primary function of circuit interrupters is to provide electrical system protection and coordination whenever abnormalities occur on any part of the system. Operating voltage, continuous current, frequency, short circuit interrupting capability, and time current coordination requirements are some of the factors that must be considered when designing a circuit interrupter. Increasing demands are being placed upon the electrical industry for interrupters with improved performance.

Associated with the foregoing are circuit breakers with high ratings that develop very high forces between contacts. This causes the operating contact assembly to develop a high speed upon opening, which in turn causes the opening contact assembly to bounce back at the end of its opening travel.

SUMMARY OF THE INVENTION

In accordance with this invention a circuit breaker is provided that comprises stationary contact means, movable contact means operable between open and closed positions of the stationary contact means, contact arm means for supporting the movable contact means and pivotally mounted for movement of the contact between said positions, a cross bar operatively connected to the contact arm means and movable between first and second positions corresponding to the open and closed positions, a circuit breaker operating mechanism releasable to effect movement of the contact arm means and comprising a link connected to the cross bar, means for preventing bouncing of the cross bar from the first to the second position after moving to said first position and comprising a stop member, the link having stop means through which the cross bar extends, the link being movable to a more retracted position than the cross bar in the first position, the link having a portion extending into the path of travel of the cross bar, the link having a strike surface engageable with the stop member as the cross bar moves from the first to the second position when the link is in the fully retracted position so as to prevent the cross bar from bouncing back to the second position, the cross bar in the first position guiding the strike surface away from the stop member when said mechanism moves the link against the cross bar to effect a closed circuit, the stop means comprising a slot surface engaging the cross bar, the stop surface being slidable over the cross bar to guide the strike surface away from the stop member when said mechanism moves the link, the stop surface is disposed at an angle to the direction of movement of the slide to and from the cross bar, and the link being movably mounted on the cross bar at an angle to the path of movement of the cross bar.

The advantage of the circuit breaker structure of this invention is that it comprises an anti-bounce device for the cross bar which prevents restriking of the contacts when the contacts are open.

DESCRIPTION OF THE PREFERRED EMBODIMENT

Figure 1:
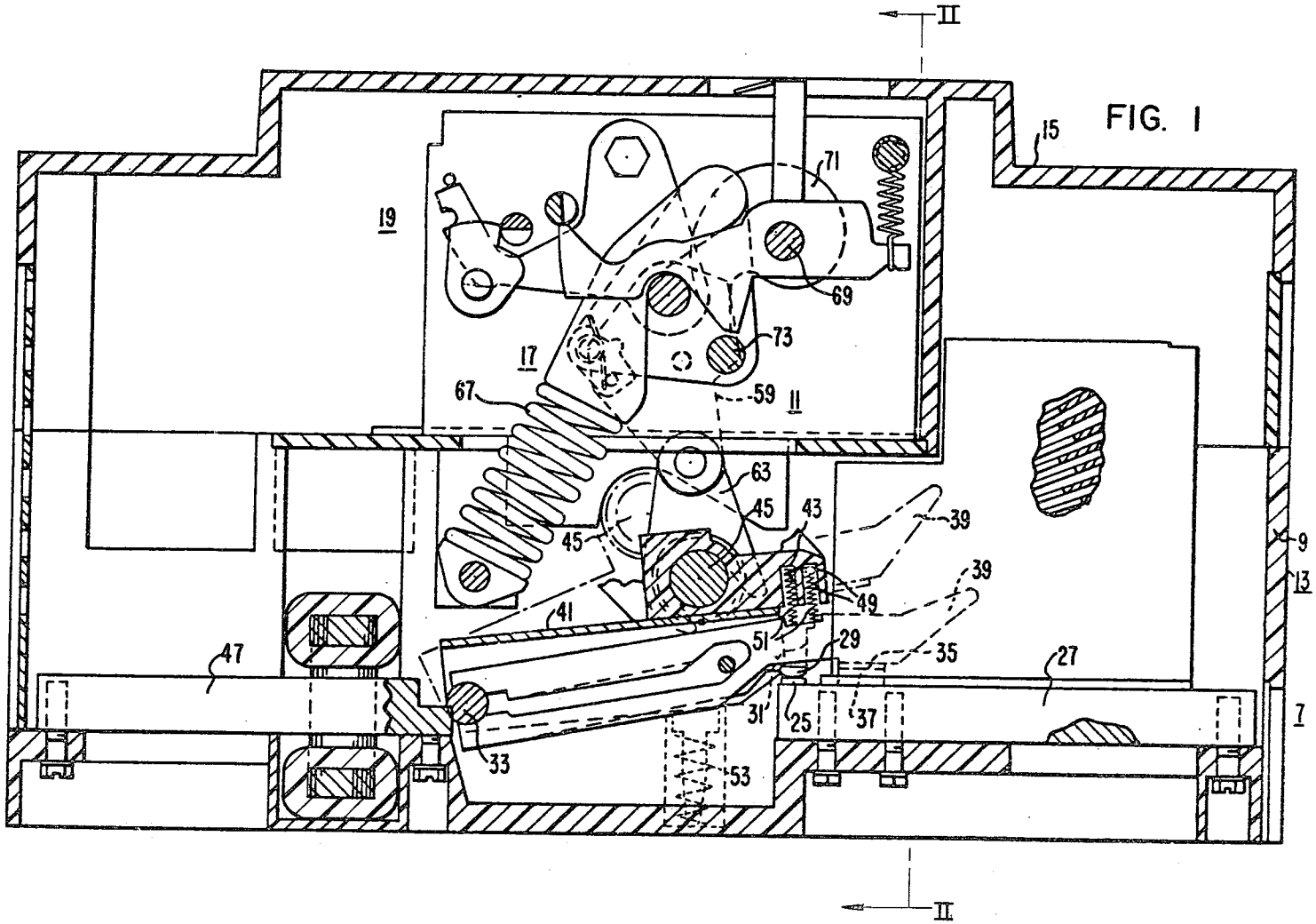
FIG. 1 is a vertical sectional view through a stored energy circuit breaker, taken on the line I—I of FIG. 2.

In FIG. 1, a circuit breaker is generally indicated at 7 and it comprises an insulating housing 9 and a circuit breaker mechanism 11 supported within the housing. The housing 9 comprises an insulating base 13 and an insulating cover 15.

The circuit breaker mechanism 11 comprises an operating mechanism 17, and a latch and trip device 19. Except for the latch and trip device, the circuit 7 is of the type that is generally disclosed in the patent to Alfred E. Maier et al., U.S. Pat. No. 4,114,005, issued Sept. 12, 1978, and is incorporated by reference herein. The circuit breaker 7 is a three-pole circuit interrupter comprising three compartments disposed in side-by-side relationship. The center pole compartment (FIG. 2) is separated from the two outer pole compartments by insulating barrier walls 21, 23 formed with the housing base 13. The circuit breaker mechanism 11 is disposed in the center pole compartment and is a single operating means for the contacts of all three pole units.

Each pole unit comprises a stationary contact 25 (FIG. 1) that is fixedly secured to a line conductor 27. For each pole unit a movable contact 29 is secured, such as by welding or brazing, to a contact arm 31. More particularly, (FIG. 2) a plurality of spaced movable contacts 29 are mounted on laterally spaced contact arms 31 for each pole. Each contact arm 31 is pivotally mounted on a pivot pin 33 which is common for all of the contact arms 31 for each pole. Each pole also comprises a moving arcing contact 35 and a stationary arcing contact 37, the former of which is mounted on arcing contact arm 39 which is pivotally mounted on pivot pin 33.

Figure 2:
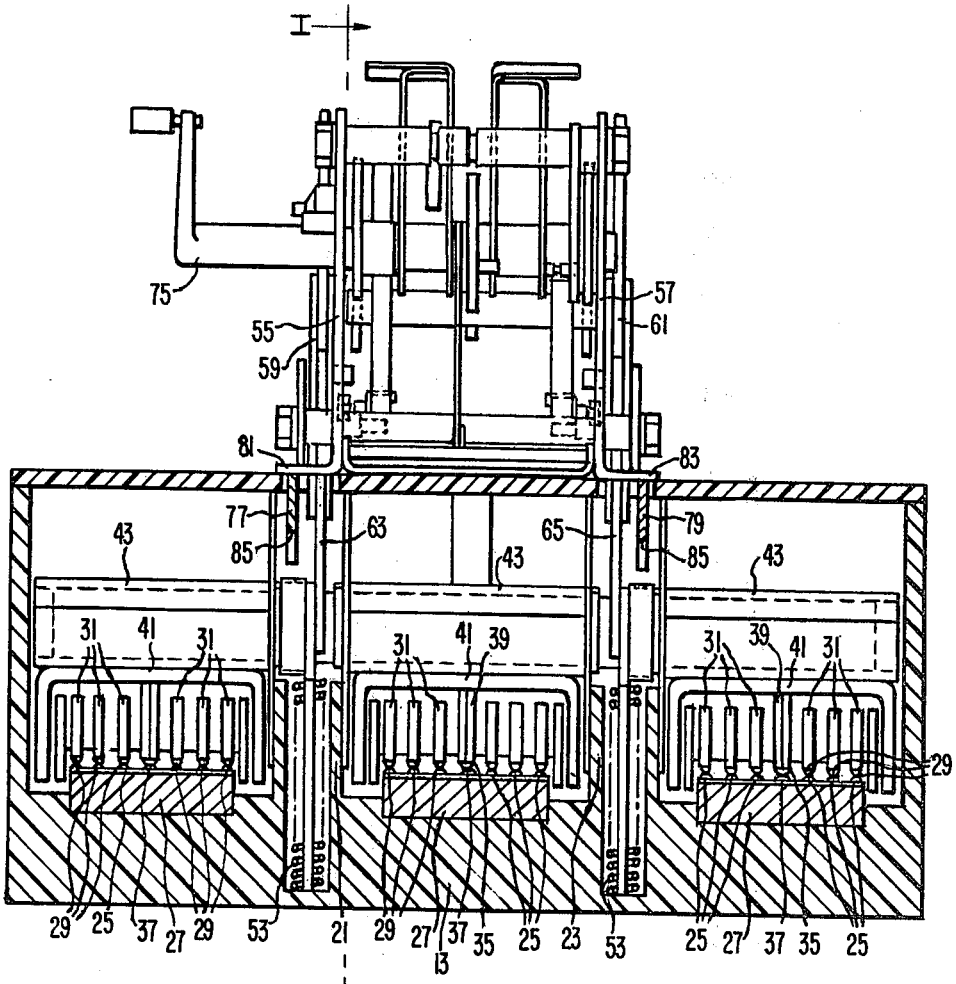
FIG. 2 is a vertical sectional view taken on the line II—II of FIG. 1.

As shown in FIG. 2, each group of contact arms 31 is contained within a support arm 41 which is likewise pivoted on the pivot pin 33. Each arm 41 supports a clamp 43 which is attached to the arm in a suitable manner in which is comprised of an electrically insulating material. The clamps 43 have aligned apertures through which a cross bar 45 extends over the three poles of the circuit breaker 7. The cross bar 45 is used to close all three poles by the circuit breaker mechanism 11. Thus, in the open postion, the contact arms 35, 39 are in a raised position as indicated by the broken line position of the arm 39, and by the broken line position of the cross bar (FIG. 1). When the contacts are closed, the circuit through the circuit breaker 7 moves from the main conductor 27 and through the contacts 25, 29, the arms 31, the pivot pin 33, and a conductor 47.

Each clamp 43 comprises a pair of two rows of holes 49 with a pair of poles being disposed over each contact arm 31. A coil spring 51 is disposed in each hole and the lower end of each spring presses against the upper side of the contact arm for holding the contacts 25, 29 in tight electrical contact. Moreover, the springs 51 as well as coil springs 53 (FIG. 2) cooperate to bias the cross bar 45 and the movable contacts 29 to the open position.

The operating mechanism 17 actuates the switch arms 41 between the open and closed positions. The mechanism is disposed between a pair of spaced support frames 55, 57. The operating mechanism 17 is described in structure and operation in U.S. Pat. No. 4,114,005, for which reason only pertinent portions of the mechanism are explained herein. The mechanism comprises a toggle including a first of spaced apart toggle links 59, 61, a second pair of spaced apart toggle links 63, 65, and closing spring assembly 67. The spring assembly 67 is charged with stored energy by a charge structure including a driven shaft 69 and a cam 71 which actuates a cam roller 73, whereby the closing spring assembly 67 is actuated from a discharge to a charged condition for closing the contacts. The driven shaft 69 may be operated either by an electric motor or manually by a crank 75.

Figure 3:
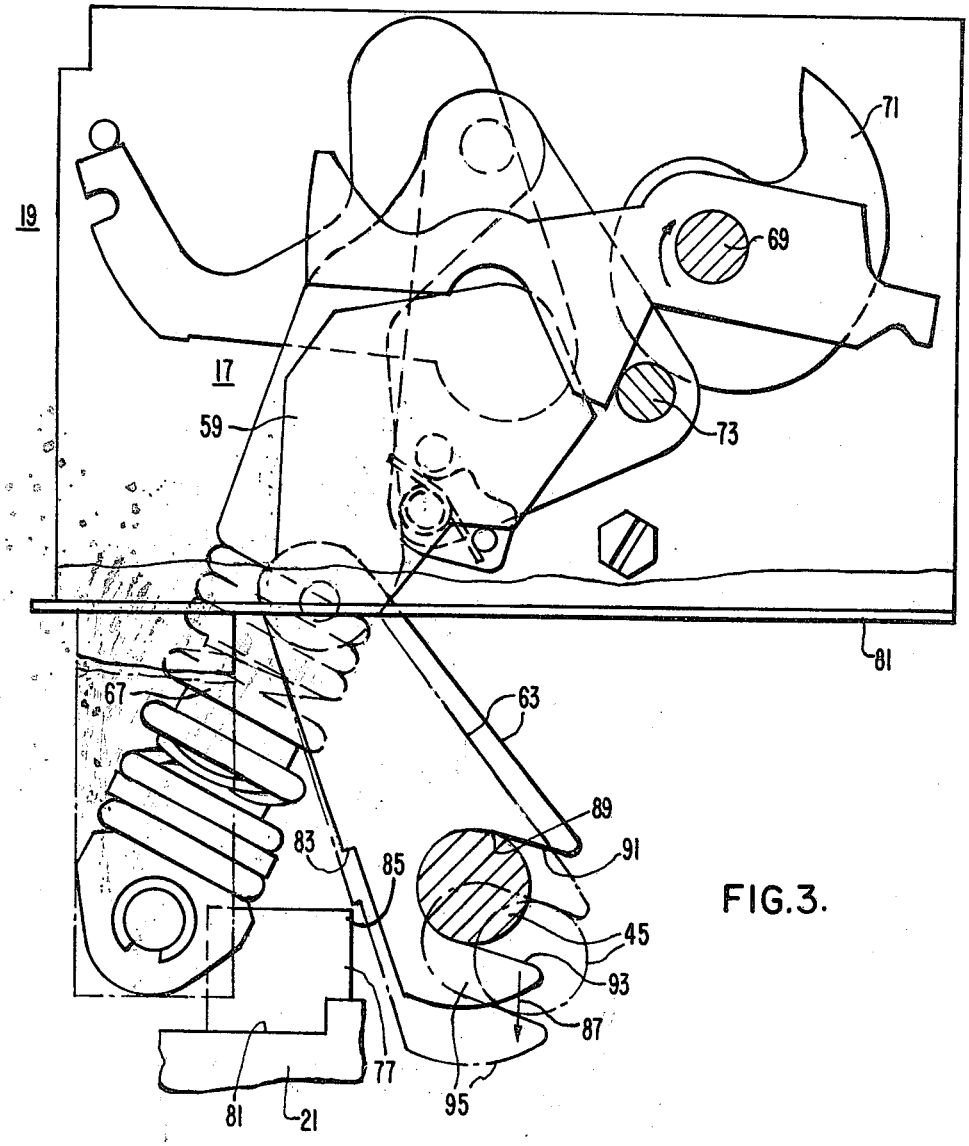
FIG. 3 is an enlarged fragmentary elevational view, partly in section, showing the anti-bounce structure.

In accordance with this invention, means for preventing bouncing of the cross bar 45 are provided and comprise stop members or blocks 77, 79 (FIGS. 2, 3). The blocks 77, 79 are mounted on upper end portions of the barrier walls 21, 23 (FIG. 2). As shown more particularly in FIG. 3 the block 77 is mounted on a shoulder 81 of the barrier wall 21. In a similar manner, the block 79 is mounted on a shoulder (not shown) of the barrier wall 23. The blocks 77, 79 cooperate with the links 63, 65 which, as shown for the link 63 (FIG. 3) are provided with strike surfaces 83 for engaging an edge 85 of the block 77.

Accordingly, when the arcing contact arm 39 (FIG. 1) moves to the upper, open position of the contacts 35, 37, the cross bar 45 raises the links 63, 65 to the uppermost position (FIG. 3). Where the force of opening of the contacts is sufficiently great, the cross bar 45 may immediately bounce back as indicated by an arrow 87 (FIG. 3). For that purpose, the links 63, 65 are provided with slot means 89 in which the cross bar 45 is located. Each notch 89 comprises notch surfaces 91, 93. As the cross bar 45 begins to bounce back it bears against the notch surface 93 and pulls the links 63, 65 downwardly. Inasmuch as the notch surfaces 91, 93 are inclined at an angle to the direction of movement of the cross bar 45 as indicated by the arrow 87, the links 63, 65 are cammed to the left (FIG. 3) whereupon the strike surfaces 83 of the links come into contact with the edges 85 of the blocks 77, 79. As a result link portions 95 extending under the cross bar 45 prevent the cross bar from lowering further and thereby avoiding the undesirable possibility of the contacts closing.

Subsequently, the links 63, 65 are elevated again to the solid line position (FIG. 3) with the cross bar 45 lodged in the inner end of the notch 89. In the latter position, the assembly of the links and cross bar are stationary and ready for intentional closing of the contacts whereupon the closing action of the toggle links 59, 61 direct the links 63, 65 against the cross bar 45 with the cross bar in the indicated position of the notches 89, 91 and thereby prevent the strike surfaces 83 from engaging the edges 85 of the block 77, 79.

In conclusion, the anti-bounce structure of this invention provides a positive means for avoiding undesirable closing of contacts and ensuing damage to the entire circuit breaker structure.

What is claimed is:

1. A circuit breaker comprising:

(a) stationary contact means;

(b) movable contact means operable between open and closed positions of the stationary contact means;

(c) contact arm means for supporting the movable contact means and pivotally mounted for movement of the contact between said position;

(d) a cross bar operatively connected to the contact arm means and movable between first and second positions corresponding to the open and closed positions;

(e) a circuit breaker operating mechanism releasable to effect movement of the contact arm means and comprising a link connected to the cross bar;

(f) means for preventing bouncing of the cross bar from the first to the second position after moving to said first position and comprising a stop member;

(g) the link having slot means through which the cross bar extends;

(h) the link being movable to a more retracted position than the cross bar in the first position;

(i) the link having a portion extending into the path of travel of the cross bar; and (j) and the link having a strike surface engageable with the stop member as the cross bar moves from the first to the second position when the link is in the fully retracted position so as to prevent the cross bar from bouncing back to the second position.

2. The circuit breaker of claim 1 in which the cross bar in the first position guides the strike surface away from the stop member when said mechanism moves the link against the cross bar to effect a closed circuit.

3. The circuit breaker of claim 2 in which the stop means comprises a stop surface engaging the cross bar, the stop surface being slidable over the cross bar to guide the strike surface away from the stop member when said mechanism moves the link.

4. The circuit breaker of claim 3 in which the stop surface is disposed at an angle to the direction of movement of the slide to and from the cross bar.

5. The circuit breaker of claim 4 in which the link is movably mounted on the cross bar in a first direction at an angle to the path of movement of the cross bar.

* * * * *